US006039182A

United States Patent [19]

Light

[11] Patent Number: 6,039,182

[45] Date of Patent: Mar. 21, 2000

[54] BAG

[76] Inventor: Barry Light, 10858 E. Verbena La., Scottsdale, Ariz. 85259

[21] Appl. No.: 09/354,973

[22] Filed: Jul. 16, 1999

[30] Foreign Application Priority Data

Aug. 13, 1998 [ZA] South Africa ..... 98/7259
Apr. 29, 1999 [ZA] South Africa ..... 99/3007

[51] Int. Cl.[7] ..... B65D 81/20

[52] U.S. Cl. ..... 206/524.8; 383/41; 383/66; 383/96; 383/211

[58] Field of Search ..... 206/422, 524.8; 383/41, 63–65, 66, 93, 96, 211; 417/313

[56] References Cited

U.S. PATENT DOCUMENTS

| | | | |
|---|---|---|---|
| 2,171,730 | 9/1939 | Lobl | 383/96 |
| 2,913,030 | 11/1959 | Fischer | 206/524.8 |
| 4,903,718 | 2/1990 | Sullivan | 383/41 |
| 5,240,112 | 8/1993 | Newburger | 206/524.8 |
| 5,480,030 | 1/1996 | Sweeney et al. | 206/524.8 |
| 5,544,752 | 8/1996 | Cox | 206/524.8 |
| 5,839,582 | 11/1998 | Strong et al. | 206/524.8 |
| 5,853,247 | 12/1998 | Shroyer | 383/41 |
| 5,881,881 | 3/1999 | Carrington | 206/524.8 |
| 5,996,800 | 12/1999 | Pratt | 206/524.8 |

*Primary Examiner*—Jim Foster
*Attorney, Agent, or Firm*—LaValle D. Ptak

[57] ABSTRACT

An evacuable plastic storage bag comprises a pair of opposed walls that define, between them, an interior volume and a mouth. The bag has a Zip-locks® closure for releasably sealing the mouth closed. The wall has a hole therein which is reinforced by an annular grommet-like plastic element. The element defines an aperture which is in communication with the interior volume of the bag and which is arranged in proximity to the closure. The wall has a plug of resiliently deformable plastic material for closing the aperture by forcing the plug into releasable engagement with the aperture. The plug and the element are disposed sufficiently close to the closure so that as the closure is pulled open, the plug is withdrawn, thereby obviating the need to withdraw the plug in a separate operation.

16 Claims, 2 Drawing Sheets

BAG

BACKGROUND

This invention relates to an evacuable storage bag and to a packaging kit including the bag.

SUMMARY OF THE INVENTION

According to a first aspect of the invention, there is provided an evacuable storage bag having first and second opposed wall portions, which between them define an interior volume and a mouth, the bag including bag closing means for releasably sealing closed the mouth of the bag and defining an aperture in the first wall portion, that is in communication with the interior volume, proximate the bag closing means, the bag including sealing means for releasably sealing closed the aperture, with the aperture being disposed sufficiently close to the bag closing means thereby to cause the aperture to open when the wall portions are moved apart from one another when the mouth of the bag is opened, in use.

The sealing means may include an aperture-defining means that is arranged in the first wall portion for defining said aperture in the wall portion, and a plug that is carried on the second wall portion in a region thereof in register with the aperture-defining means and that can releasably engage the aperture-defining means to seat snugly in the aperture of the aperture-defining means.

The plug of the sealing means may be of a resiliently deformable material thereby to engage the aperture-defining means releasably.

The aperture-defining means may be a grommet-like element.

The sealing means may be in the form of an adhesive pad that is carried on the second wall portion in a region thereof in register with the aperture to permit a region of the first wall portion, surrounding the aperture, to releasably adhere to the adhesive pad, thereby releasably sealing the aperture closed.

The bag may include attachment means arranged on the first wall portion, for the attachment of evacuation means for evacuating air from the interior volume through the aperture.

The bag closing means may be in the form of a Zip-locks® closure.

According to a second aspect of the invention, there is provided a packaging kit which includes an evacuable storage bag having first and second opposed wall portions which between them define an interior volume and a mouth, the bag including bag closing means for releasably sealing closed the mouth of the bag and defining an aperture in the first wall portion that is in communication with the interior volume, proximate the bag closing means, the bag including sealing means for releasably sealing closed the aperture, with the aperture being disposed sufficiently close to the bag closing means thereby to cause the aperture to open when the wall portions are moved apart from one another when the mouth of the bag is opened, in use; and evacuation means for evacuating air from the interior volume of the bag through said aperture.

The sealing means of the bag may include an aperture-defining means that is arranged in the first wall portion for defining said aperture in the wall portion, and a plug that is carried on the second wall portion on a region thereof in register with the aperture-defining means, and that releasably engages the aperture-defining means to seat snugly in the aperture of the aperture-defining means.

The plug of the sealing means of the bag may be of resiliently deformable material thereby to engage the aperture-defining means releasably.

The aperture-defining means of the bag may be a grommet-like element.

The sealing means of the bag may be in the form of an adhesive pad that is carried on the second wall portion of the bag on a region thereof in register with the aperture, to permit a region of the first wall portion, surrounding the aperture, to releasably adhere to the adhesive pad thereby releasably sealing the aperture closed.

The bag may include attachment means arranged on the first wall portion, for the attachment of evacuation means for evacuating air from the interior volume through the aperture.

The bag closing means of the bag may be in the form of a Zip-lock® closure.

The invention and the manner in which it can be put into practice will not be described in more detail by way of example, with reference to the accompanying diagrammatic drawings.

DETAILED DESCRIPTION

Figure 1:
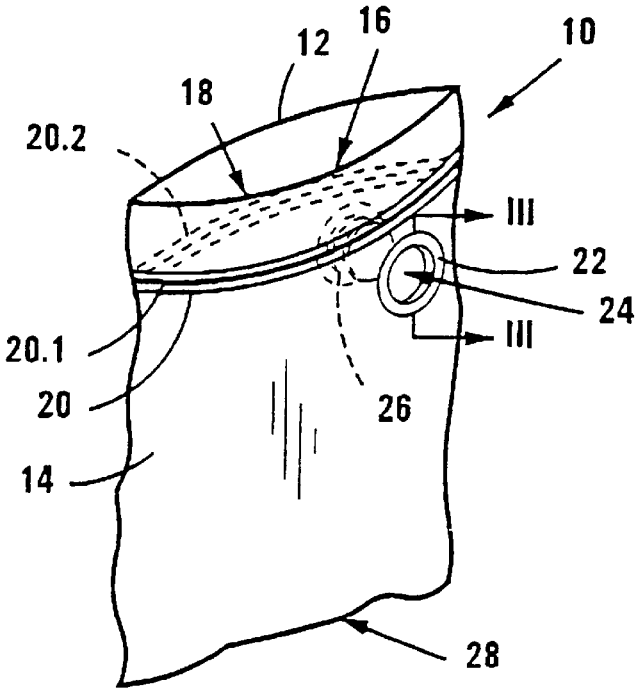
FIG. 1 is a three dimensional view of a bag in accordance with the invention in an open condition.
Figure 2:
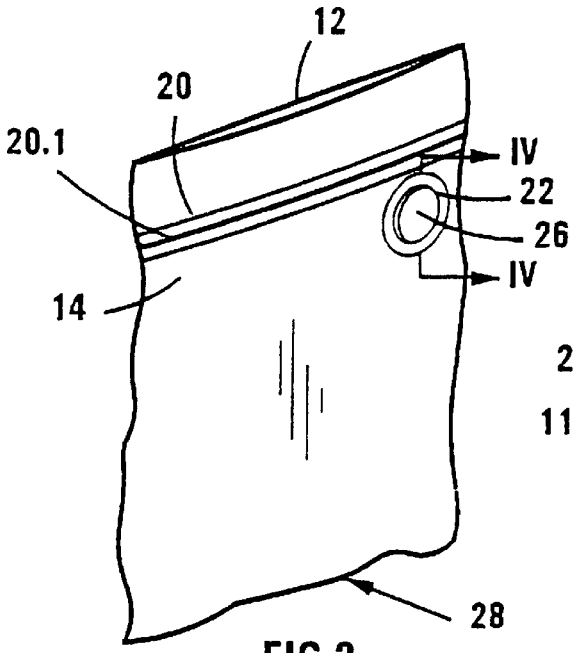
FIG. 2 is a three dimensional view of the bag of FIG. 1 in a closed condition.

Referring to FIGS. 1 to 5 of the drawings, reference numeral 10 generally designates a bag in accordance with the invention. The bag 10 is of synthetic plastic material and comprises a pair of opposed flexible walls 12 and 14. The walls 12 and 14 define, between them, an interior volume 16 and a mouth 18.

The bag 10 includes bag closing means in the form of a closure 20 of the type commonly referred to as a Zip-locks® closure, for sealing the mouth closed. The closure 20 comprises two releasably engagable complementary tongue and groove strips 20.1 and 20.2. The strip 20.2 of the closure defines a groove formation and is disposed on the wall 12 in register with the strip 20.1, which defines a complementary tongue formation.

The wall 14 has a hole 21 therein which is reinforced by an annular, grommet-like plastic element 22. The element 22 defines an aperture 24. The aperture 24 is arranged in proximity to the closure 20 and in communication with the interior volume 16.

Attached to the wall 12 is a plug 26 of resiliently deformable plastic material. The plug 26 has a neck portion 26.1 and a head portion 26.2. The plug 26 is carried on the wall 12 so as to be in register with the aperture 24. In use, once articles to be stored have been placed in the bag 10, the mouth 16 is sealed closed by the closure 20 by securing the strips 20.1 and 20.2 to each other. The bag 10 is squeezed progressively from a bottom end 28 thereof towards the mouth 18, thus forcing air out of the interior volume 14 via the aperture 24. The aperture 24 then is closed by forcing the element 20 over the head portion 26.2 of the plug 26; so that the neck portion extends through the aperture 24. The neck portion 26.1 and the aperture 24 are dimensioned such that the neck portion 26.1 seats snugly in the aperture 24. This assists in rendering the bag 10 substantially airtight when the closure 20 is closed.

When contents are to be removed from the bag 10, the closure 20 is opened. The resilient deformability of the plug 26 allows the plug to be withdrawn from the aperture 24. The element 22 and the plug 26 are disposed sufficiently close to the closure 20 so that as the closure 20 is pulled open, the plug 26 is withdrawn from the element 22, substantially simultaneously. Hence, the need to withdraw the plug 26 from the element 22 in a separate operation is obviated.

Figure 5:
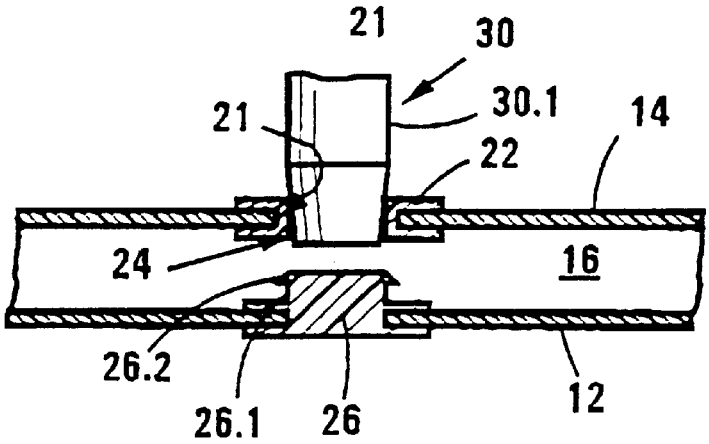
FIG. 5 is the section shown in FIG. 3 and including part of an evacuation means.

With reference to FIG. 5 of the drawings, as an alternative to evacuating air from the bag 10 by squeezing the bag as described above, air may be evacuated by means of an evacuation pump 30. In this case, once the mouth 16 has been closed by the closure 20, a tapered end of a suction pipe 30.1 of the pump 30 is inserted into the aperture 24. The suction pipe 30.1 is a snug fit in the aperture 24, the element 22 thus serving as a means for attaching the pump 30 to the bag 10. Once air has been evacuated from the interior volume 14, the suction pipe 30.1 is withdrawn from the aperture 24 and the aperture 24 is closed by means of the plug 26, as described above.

The Applicant envisages that a plurality of the bags 10 and the pump 30 will be supplied together as a packaging kit. As such, the invention extends to a packaging kit including the bag and the evacuation pump 30.

Figure 6:
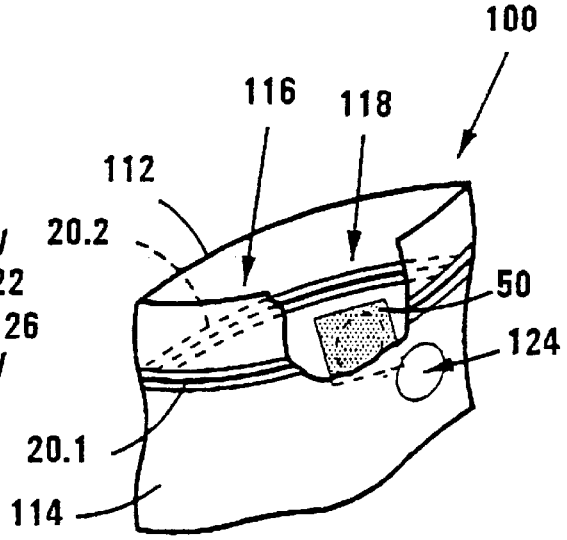
FIG. 6 is a fragmentary three-dimensional view of another embodiment of a bag in accordance with the invention.
Figure 3:
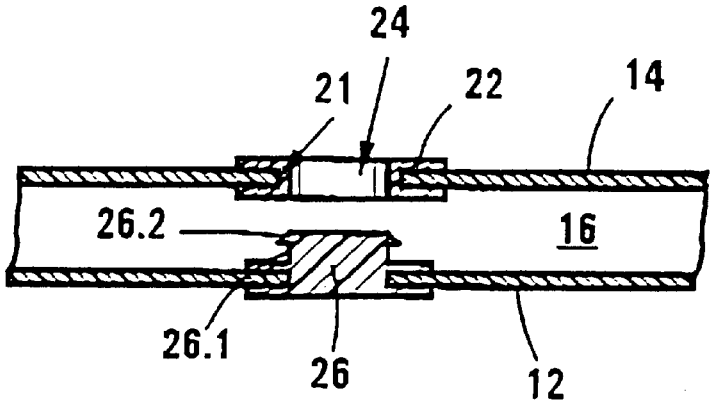
FIG. 3 is a sectional side view taken along line III—III in FIG. 1.
Figure 4:
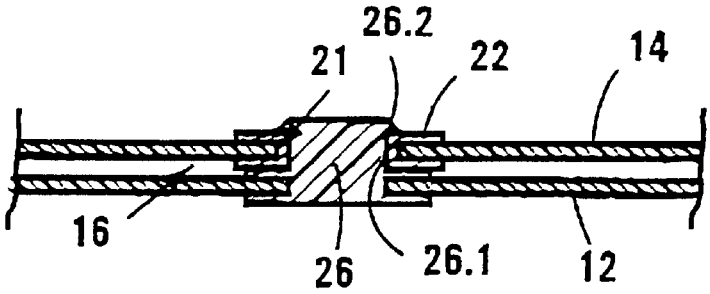
FIG. 4 is a sectional side view taken along line IV—IV in FIG. 2.

With reference to FIG. 6 of the drawings, another embodiment of the a bag in accordance with the invention is designated generally by the reference numeral 100. The same and/or similar features of the bag 100 to those of the bag 10 are represented herein by the same and/or similar reference numbers.

As for the bag 10, the bag 100 is of synthetic plastic material and includes two opposed wall portions 112 and 114 defining between them an interior volume 116 and a mouth 118. The wall portion 114 defines an aperture 124 that is in communication with the interior volume 116. The wall portion 112 has an adhesive pad 50 attached thereto in register with the aperture 124. As such, the bag 100 is used in similar fashion to the bag 10, with the aperture 124 being releasably sealed closed by pushing a region of the wall portion 114 surrounding the aperture against the adhesive pad 50 causing it to releasably adhere thereto.

As for the bag 10, the aperture 124 of the bag 100 is disposed sufficiently close to the closure 20 so that when the mouth of the bag is opened, the wall portion 114 in the region of the aperture is pulled away from the adhesive pad, thereby opening the aperture. This obviates the need to open the aperture 124 in a separate operation.

The foregoing description of the preferred embodiments of the invention is to be considered as illustrative of the invention, and not as limiting. The materials which have been mentioned may be varied in accordance with different desired operating characteristics; and the particular relative size and arrangement of parts, which have been illustrated, also may be varied as required. Other changes and modifications will occur to those skilled in the art for performing substantially the same function, in substantially the same way, to achieve substantially the same result without departing from the true scope of the invention as defined in the appended claims.

What is claimed is:

1. An evacuable storage bag having first and second opposed wall portions which between them define an interior volume and a mouth, the bag including bag closing means for releasably sealing closed the mouth of the bag, the bag having an aperture in the first wall portion in communication with the interior volume, proximate the bag closing means; and the bag including sealing means for releasably sealing closed the aperture, with the aperture being disposed sufficiently close to the bag closing means thereby to cause the aperture to open when the wall portions are moved apart from one another when the mouth of the bag is opened in use.

2. A storage bag as claimed in claim 1, wherein the sealing means includes an aperture-defining means in the first wall portion for defining said aperture in the wall portion; and a plug that is carried on the second wall portion in a region thereof in register with the aperture-defining means and that can releasably engage the aperture-defining means to seat snugly in the aperture of the aperture-defining means.

3. A bag as claimed in claim 2 wherein the plug of the sealing means is of a resiliently deformable material thereby to engage the aperture-defining means releasably; and the aperture-defining means is a grommet-like element.

4. A bag as claimed in claim 1 wherein the sealing means is in the form of an adhesive pad that is carried on the second wall portion in a region thereof in register with the aperture to permit a region of the first wall portion, surrounding the aperture, to releasably adhere to the adhesive pad thereby releasably sealing the aperture closed.

5. A bag as claimed in claim 4 wherein the bag includes attachment means arranged on the first wall portion for the attachment of an evacuation means for evacuating air from the interior volume through the aperture.

6. A bag as claimed in claim 1 wherein the plug of the sealing means is of a resiliently deformable material thereby to engage the aperture-defining means releasably; and the aperture-defining means is a grommet-like element.

7. A bag as claimed in claim 6 wherein the bag includes attachment means arranged on the first wall portion for the attachment of an evacuation means for evacuating air from the interior volume through the aperture.

8. A bag as claimed in claim 1 wherein the bag includes attachment means arranged on the first wall portion for the attachment of an evacuation means for evacuating air from the interior volume through the aperture.

9. A packaging kit which includes:

an evacuable storage bag having first and second opposed wall portions which between them define an interior volume and a mouth, the bag including bag closing means for releasably sealing closed the mouth of the bag and with an aperture in the first wall portion in communication with the interior volume, proximate the bag closing means, and the bag including sealing means for releasably sealing closed the aperture with the apreture being disposed sufficiently close to the bag closing means thereby to cause the aperture to open when the wall portions are moved apart from one another when the mouth of the bag is opened in use; and evacuation means for evacuating air from the interior volume of the bag through said aperture.

10. A packaging kit as claimed in claim 9 wherein the sealing means of the bag includes an aperture-defining means in the first wall portion for defining said aperture in the wall portion; and a plug that is carried on the second wall portion on a region thereof in register with the aperture-defining means and that releasably engages the aperture-defining means to seat snugly in the aperture of the aperture-defining means.

11. A packaging kit as claimed in claim 10 wherein the plug of the sealing means of the bag is of resiliently deformable material to engage the aperture-defining means releasably, and the aperture-defining means of the bag is a grommet-like element.

12. A packaging kit as claimed in claim 9 wherein the sealing means of the bag is in the form of an adhesive pad that is carried on the second wall portion of the bag on a region thereof in register with the aperture, to permit a region of the first wall portion, surrounding the aperture, to releasably adhere to the adhesive pad thereby releasably sealing the aperture closed.

13. A packaging kit as claimed in claim 12 wherein the bag includes attachment means arranged on the first wall portion for the attachment of an evacuation means for evacuating air from the interior volume through the aperture.

14. A packaging kit as claimed in claim 9 wherein the plug of the sealing means of the bag is of resiliently deformable material to engage the aperture-defining means releasably, and the aperture-defining means of the bag is a grommet-like element.

15. A packaging kit as claimed in claim 14 wherein the bag includes attachment means arranged on the first wall portion for the attachment of an evacuation means for evacuating air from the interior volume through the aperture.

16. A packaging kit as claimed in claim 9 wherein the bag includes attachment means arranged on the first wall portion for the attachment of an evacuation means for evacuating air from the interior volume through the aperture.

* * * * *